United States Patent [19]

Scherr, III

[11] 3,988,215

[45] Oct. 26, 1976

[54] METHOD FOR RECORDING POTENTIAL CAPACITY OF A FORMED FOIL IN A CONTINUOUS FOIL FORMING PROCESS

[75] Inventor: Albert E. Scherr, III, Williamstown, Mass.

[73] Assignee: Sprague Electric Company, North Adams, Mass.

[22] Filed: May 8, 1975

[21] Appl. No.: 575,847

Related U.S. Application Data

[63] Continuation-in-part of Ser. No. 434,715, Jan. 18, 1974, abandoned.

[52] U.S. Cl. ..... 204/28; 204/56 R; 204/206; 204/211; 29/25.41; 29/25.42; 73/105; 73/489; 73/490; 324/60 C; 324/163; 324/172; 324/177; 317/230

[51] Int. Cl.[2] ..... C25D 7/00; C25D 11/00

[58] Field of Search ..... 204/13, 28, 56 R, 206, 204/211; 324/60 C, 71 R; 73/105, 489, 490; 29/570, 574, 25.41, 25.42; 317/230

[56] References Cited

UNITED STATES PATENTS

| | | | |
|---|---|---|---|
| 1,965,399 | 7/1934 | Wehe | 204/211 |
| 2,494,852 | 1/1950 | Winterhalter et al. | 204/211 |
| 3,061,534 | 10/1962 | Jasperson | 204/211 |
| 3,378,767 | 4/1968 | Moore et al. | 324/71 R |
| 3,536,601 | 10/1970 | Hill et al. | 204/147 |

*Primary Examiner*—John H. Mack
*Assistant Examiner*—Aaron Weisstuch
*Attorney, Agent, or Firm*—Connolly and Hutz

[57] ABSTRACT

In a continuous electrolytic foil forming process employing a constant d.c. voltage power supply, the speed with which the foil is drawn through the electrolyte is automatically adjusted by a feedback mechanism to maintain a constant value of forming current. In this process, the speed of drawing the foil corresponds inversely to the potential capacity of the foil as it enters the electrolyte at any given time. This speed or equivalent capacity and the corresponding location of the foil is monitored and recorded during the continuous film forming process.

15 Claims, 2 Drawing Figures

Fig. 1.
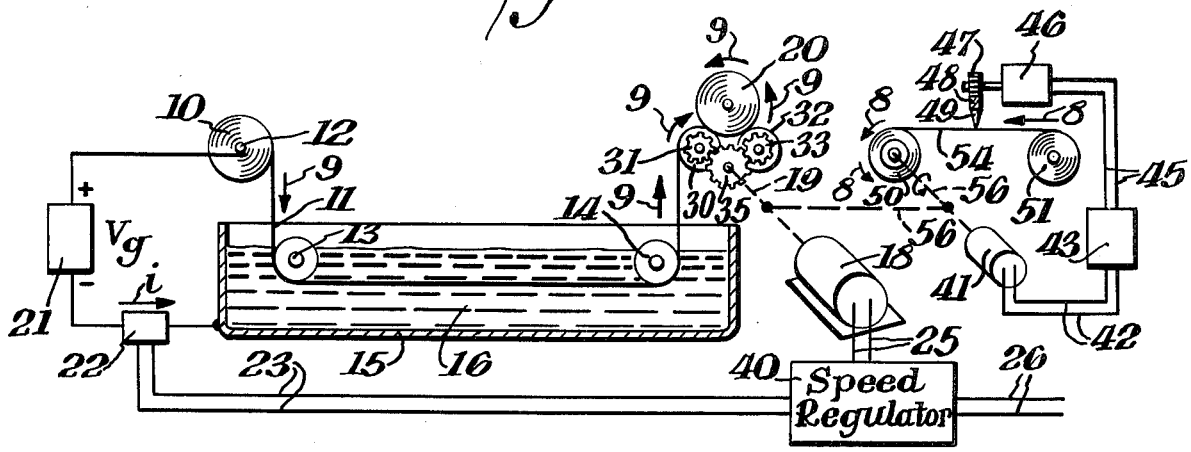
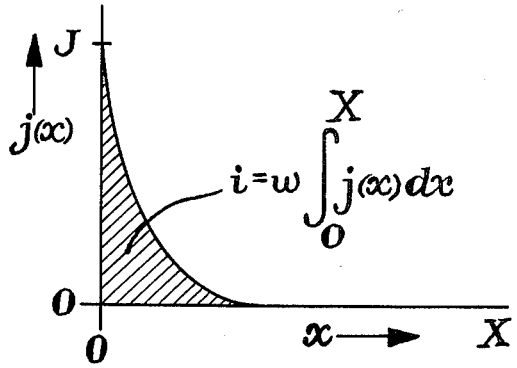
Fig. 2.

METHOD FOR RECORDING POTENTIAL CAPACITY OF A FORMED FOIL IN A CONTINUOUS FOIL FORMING PROCESS

CROSS REFERENCES TO RELATED APPLICATIONS

The present application is a continuation-in-part of application Ser. No. 434,715, filed Jan. 18, 1974, now abandoned.

BACKGROUND OF THE INVENTION

The present invention relates to a continuous process for forming an oxide film on the surfaces of a valve-metal, and to the measurement and recording of the potential capacity of such a formed foil. Such formed foil is typically employed in the manufacture of electrolytic capacitors. The word "forming" and variations thereof are used herein to mean anodizing, as is common practice in the art.

Formed foil is conventionally made by drawing at a constant speed, a bare etched metal foil strip through a liquid electrolyte solution and applying a fixed d.c. voltage between the foil and a negative electrode that is also submersed in the electrolyte solution. In this conventional process, the formation current, the ultimate oxide film thickness, and the potential capacitance of the foil all vary in response to variations in etch ratio along the foil.

Potential capacity of the foil in a given region, is defined as the value of electrical capacity per unit square area of the foil as measured, for example by a capacitance bridge, between the foil as one electrode and a liquid electrolyte in which the foil is submersed as the other electrode. This measurement is normally carried out by using a sample of the foil to be characterized, which sample has a known square area. It has not been practical to measure the potential capacity of the immersed foil in a continuous formation machine, even by stopping the process, because portions of the foil submersed therein are only partially formed.

An arduous and costly sampling method for making this measurement is performed in practice, after a complete roll of foil, perhaps hundreds of feet long, has been formed.

It is customary to form foil in widths of one foot or more. Thereafter, the foil is typically slit to widths on the order of one to five inches. Subsequently the slit rolls of formed foil are cut to lengths that correspond to a desired capacity value. Typically each such cut length of foil has stitched to it a metal tab that becomes the anode lead of the capacitor. The length of foil is then typically overlaid with porous insulating layers and a counter-electrode and wound into a cylindrical capacitor section. The section is impregnated or immersed in a liquid electrolyte which itself becomes the cathode of the capacitor. The oxide film that is formed on both faces of the foil is the dielectric for the capacitor.

The potential capacity per unit area of formed foil may vary as much as 50% within a master roll of formed foil. A master roll is usually characterized by taking two or more sample measurements of potential capacity at widely spaced intervals along the foil. After slitting, the foil is cut into equal lengths and the capacitors made therefrom typically have capacity values ranging from +0 to +50% of a nominal value. This is often a practical method since many capacitor users specify a minimum capacity value. However, most such capacitors contain a large excess of foil and thus represent excess costs.

Alternatively, the foil is slit, and rewound into small rolls each containing a length of foil typically only 50 times the nominal desired final length for use in a section. Each such small roll is characterized for capacity so that all capacitors made from that roll will likely fall within a narrower capacity tolerance. Clearly the added cost of this approach is high and a point of diminishing returns is soon reached as it is attempted to reduce the capacity range within which capacitors are manufactured. Further, the impracticality for automating these operations has placed a lower limit on the ultimate costs of foil electrolytic capacitors.

It is therefore an object of this invention to provide a low cost method for monitoring and recording the potential capacitance of a formed film.

It is another object of this invention to provide a method for monitoring and recording the potential capacitance of a formed foil, which data represents all regions along the foil.

It is a further object of this invention to provide a method for monitoring and recording the potential capacity of a formed foil during the foil forming process.

It is a further object of this invention to make practical automatic methods for accurately cutting formed foil to lengths, each corresponding to a predetermined capacity value.

It is a further object of this invention to reduce the cost of manufacturing electrolytic foil-electrode capacitors.

It is yet a further object of this invention to provide a means for making electrolytic foil-electrode capacitors to a narrow capacity tolerance.

These and other objects will become apparent from the following description.

The objects of the present invention are realized by combining novel capacitance monitoring and recording techniques with a method for forming foil that is disclosed in an application for U.S. Pat. Ser. No. 539,360, filed Jan. 8, 1975.

SUMMARY OF THE INVENTION

A method is described for monitoring and recording the potential capacitance of an electrolytically formed valve-metal foil, during a continuous oxide formation process. The method comprises continuously drawing a foil through an electrolyte, applying a constant d.c. voltage between the electrolyte and the foil, sensing the forming current, varying the drawing speed inversely with the forming current so as to maintain the forming current essentially constant at a predetermined desired value, and monitoring and recording the speed of foil drawing with the corresponding location along the foil. This forming process provides a corresponding relationship between the potential capacity of the foil as it enters the electrolyte and the speed of the drawing at any given time. Thus the recording of drawing speed and corresponding location along the foil provides a formed foil whose potential capacitance is known in every region along its entire length. It is by these means practical for the first time, in the manufacture of foil type electrolytic capacitors, to continuously unroll a sheet of formed foil and accurately cut it to lengths corresponding to known potential capacity values associated with each such length to obtain foil lengths all having a predetermined desired potential capacitance.

BRIEF DESCRIPTION OF THE DRAWINGS

In FIG. 1 is shown schematically a machine for performing the method of this invention.

In FIG. 2 is shown a graphical plot of the forming current density as a function of distance along the submersed foil, in the machine of FIG. 1.

DESCRIPTION OF THE PREFERRED EMBODIMENTS

In FIG. 1 is shown in schematic form an apparatus for carrying out the process of the present invention. A supply roll 10 of etched foil 11 is supported by a spindle 12. The outer end of foil 11 is threaded under a first and second idler roller, 13 and 14, respectively, such that between these idler rollers the film 11 is horizontal. Of course, the foil may be drawn vertically or at any convenient angle as may be dictated by other factors of machine design.

The foil 11 is further threaded over driven spindles 30 and 32 of equal diameter and is finally wound into a roll 20 of formed foil. The roll 20 is supported and turned so as to continuously collect the formed foil by the two driven spindles 30 and 32. The route of the threaded foil 11 is shown by arrows 9. Fixed to each of spindles 30 and 32 are identical gears 31 and 33, respectively, that are driven by meshing gear 35, which in turn is driven by drive coupling 19 represented by a dotted line. The coupling 19 is driven by a variable speed motor 18. The coupling 19 represents any of several well known coupling means that assures correspondence between the motor speed and the rate of rotation of spindles 30 and 32. This coupling typically comprises a gear reduction box, but it may be simply a shaft. In any case, the foil is drawn at a speed that is proportional to the motor speed, without regard to the diameter of the collecting roll 20.

The d.c. power supply 21 supplies a constant voltage between the foil 11 at spindle 12 and the electrolyte 16 at the tank 15. A low impedance current sensing device 22 is connected in series with this circuit. The output of this sensing device 22 is connected by wires 23 to a motor speed regulator 40. The output voltage of the sensing device 22 is proportional to the forming current $i$. Thus the sensing device 22 may be a simple low value resistor.

The motor speed regulator 40 receives energy from an a.c. power line 26 and by connection via wires 25 to the variable speed motor 18, controls its speed. The speed regulator 40 causes the motor 18 to decrease speed when the signal from sensing device 22 increases and vice versa. The regulator 40 is preprogramed to maintain the sensing device signal and thus the forming current at a predetermined value.

In FIG. 2 is shown a curve representing the forming current density $j\ (x)$ in the apparatus of FIG. 1, as a function of distance $x$ along the submersed foil, at a time when all the submersed foil has an above normal etch ratio. The speed with which the foil is being drawn through the electrolyte has been increased so that the total current $i$ is maintained by the above described feedback mechanism, as is more fully explained in the aforementioned co-pending application.

The initial current density J is approximately proportional to the foil etch ratio. This is predicated on the fact that in the case of the higher etch ratio, the area of contact between the foil and the electrolyte is proportionally greater and the resistance of the electrolyte in a region is inversely proportional to the etch ratio.

It is preferred that the motor 18 be d.c. shunt type, having a field winding connected to a constant d.c. voltage that may be derived from the a.c. power line 26. The regulator 40 would then supply a variable d.c. voltage via wires 25 to the armature winding of the motor 18.

In the process of this invention, the source voltage is held constant, and the foil speed is varied so as to keep the total current at a predetermined constant value at all times. Thus for example, when in the continuous forming process of this invention the foil etch ratio increases, the foil drawing speed is reduced by an amount necessary to prevent an increase in total forming current and therefore to hold the total forming current constant. The fact that the current is maintained constant, insures that the voltage drops in each element of the series circuit are each maintained constant. The overall voltage drops in the electrolyte and in the foil are maintained constant. The result is the production of foil having a uniformly thick oxide film over its entire length. The further result is the production of a formed foil wherein the potential capacity of each unit plane area region of the foil varies proportionally with the etch ratio in that area. But since the speed of drawing the foil during formation was varied inversely with the etch ratio, the potential capacity of a region of the foil that exits from the electrolyte is inversely proportional to the speed of drawing the foil at that time. Thus for a given set of operating conditions in the formation process of this invention, the factor or proportionality between potential capacity of the foil and the reciprocal of the drawing speed, may be determined by measuring potential capacity of one sample from the foil and the corresponding drawing speed.

According to the principles of the present invention a valve-metal foil, such as tantalum or aluminum, is formed in a continuous electrolytic process wherein a constant voltage is applied, the forming current is maintained constant by varying the foil drawing speed, and the drawing speed is monitored and recorded during the formation process. The value of the recorded drawing speed that is associated with each region of the foil has a corresponding potential capacity value that may be computed on a "real time" basis, or subsequent to forming a complete roll or other quantity of foil.

Such monitoring and recording may be accomplished by means of additional machinery as schematically shown in a first preferred embodiment of FIG. 1. A strip chart recorder is comprised of a driven spindle 56 to which a paper chart 54 is attached and by which the chart paper is drawn into a roll 50. The paper is drawn from a supply roll 51 and follows the route indicated by arrows 8. The spindle 56 is driven by the motor 18, as is schematically shown by connection to coupling 19. The speed of rotation of spindle 56 and the drawing speed of the paper are thus proportional to the drawing speed of the foil 11. The speed of the chart paper 54 is preferably lower than the speed of the foil 11, which may be accomplished by a number of well known means such as speed reducing gears (not shown). A tachometer 41 is driven also by spindle 56 and its voltage output is proportional to the paper and foil drawing speeds. The output of tachometer 41 is connected by wires 42 to the input of a servo amplifier 43 that includes a standard signal offset feature. The offset voltage is adjusted so that only the foil speeds in the range of interest are recorded over the full width of the chart paper. The output of amplifier 43 is connected by wires 45 to a servo motor 46 that in turn is mechanically coupled by means of driving pinion 47 and rack 48 to inking pen 49 that is positioned on the paper. Thus the lateral position (toward and away from the viewer as shown in FIG. 1) of the pen 49, changes linearly with the drawing speed of the foil, over the range of foil speeds of interest. Many other known tape or chart drive systems are equivalent and suitable for use here.

The foil drawing speed is thus continuously monitored and recorded on chart paper and each region along the paper corresponds to a particular region along the foil. The amplifier may be the inverting type, and the chart paper may be calibrated directly in values of potential capacity.

An alternative method of monitoring the speed of the motor, when the motor is a d.c. shunt type as has been described as preferred above, consists of measuring the variable d.c. voltage that appears across the wires 25 in FIG. 1. The magnitude of this voltage is proportional in this case to the speed of the motor.

Many variations in the means for monitoring and recording are possible. The chart paper may be driven at a constant speed by independent means and the location along the foil may be continuously determined by integrating a signal, as from a tachometer, that is proportional to foil drawing speed. The value of this integrated signal then would correspond to the distance along the foil and may be recorded also on the chart paper. An alternative to an ink recording of the capacitor value may be the recording on the chart paper by magnetic ink so that it may be automatically read in a subsequent process for cutting the foil into pieces all having a predetermined desired total potential capacity value. Known and suitable magnetic inks are comprised of ferrous particles suspended in a liquid vehicle.

A further alternative would be the substitution of paper tape for the strip chart, that would be code punched for recording and subsequent automatic reading of the data. Conventional magnetic recording tape may be similarly employed. If a recording of the potential capacity values of a particular "master" roll of formed foil has been made using magnetic tape, punched tape or a strip-chart; the stored data may be read or replayed in a synchronized manner with the unrolling of a slit roll obtained from the "master" roll; the slit roll being periodically cut to lengths indicated by the data being read, as both foil and recording progressively unfold. The same stored data may repeatedly be subsequently replayed with another slit roll obtained from the same master roll. Alternatively, instead of periodically cutting the foil to lengths indicated by the stored data, the foil may be periodically tab stitched at intervals along the foil, the spacing of which intervals corresponds to the desired foil lengths. Then in a subsequent operation the foil is cut to these lengths as indicated by the spacing of the stitched tabs.

More generally any of the various known data storage systems may be used. Those just described are of the type wherein data is recorded on an appropriate kind of film that is drawn at either a constant rate or at a rate proportional to the speed of the foil drawing or motor. Many other analogue and digital recording and data storage equipments will be suitable for this purpose.

A more direct method of recording would consist in the periodic marking of the foil itself with the values of potential capacity, which method has the advantage of always maintaining intact the essentially paired data comprised of the location along the foil and the corresponding potential capacity value. Here again, the use of magnetic ink printing or the coded punching of the foil, for example along one edge, represent two recording techniques permitting a subsequent manual or automatic reading.

In the above discussion of the principles of this invention it has been assumed that the etch ratio of the valve metal foil being formed has a constant value across the width of the foil. This may be the case for narrow foil of only a few inches in width but it is desirable in normal practice to employ much wider foil, such as one or more feet wide, for etching and forming. Prior to and without the above described method for compensating at formation for variations in etch ratio along the length of a foil, variations in etch ratio across the width of a foil have had relatively unimportant consequences. However, in combination with this recent improvement in a formation process, effective methods for compensating for variations in etch ratio along the width of a foil become particularly advantageous.

After etching, wide foil having a width of about two feet usually exhibits a change in etch ratio across the width of the foil of as much as 20% and seldom less than 5%. For a given roll of foil having been etched on a continuous etching machine, this variation is typically the same along the entire length of the foil within one roll.

When such a wide foil is formed according to this invention and as described above, each value of capacitance that is recorded corresponding to a given location along the length of the foil, represents the average capacitance at that location from one edge to the other. Thus the capacitance per unit area of rolls of foil that are made by slitting the wide foil lengthwise, are different from roll to roll, although the capacitance at each location along the foil in each roll has an unique relationship to the recorded value for that location.

This unique relationship can be determined for each such small roll of slit foil strips by first measuring and determining the characteristic variation of etch ratio across the width of a given wide roll, either before or after the forming step. One of the small rolls that is slit from the wide roll will have a one to one correlation between its actual and recorded capacitance. The unique relationship between the recorded and the actual capacitance per unit area of each other small roll can then be readily determined, which relationship will be a simple constant multiplier that is near unity.

Thus, the knowledge that the lateral etch ratio gradient is constant throughout the wide master roll enables the determination of an appropriate correction factor to be applieid to the recorded data representing the master role. The corrected data that then corresponds to each individual small roll or strip that has been slit from a given portion within the width of the master roll is thereby readily determined and in a subsequent step of cutting the strips of slit foil to a length, each length having a predetermined desired potential capacitance value, the proper cutting may be easily determined manually. Alternatively a specialized computer having been fed the recorded data and the correction factors may be programed to direct the desired cutting to length.

The complexity of these steps for accounting for variations of etch ratio across the width of a wide foil can be overcome by the alternative step of forming only narrow, pre-slit foil, the width of which is determined to be appropriate for rolling directly into specific capacitors. Of course the narrower widths have less variation of etch ratio across the foil width but whatever variation exists is now completely accounted for at formation since it is the average value across the width that is adjusted for in the formation process of this invention. This method has the disadvantage of requiring more foil drawing machinery to generate the same amount of formed foil. However, many such smaller machines can be operated from a single constant voltage source provided each formation machine includes an individual current sensing device. Thus a large voltage source, which may constitute a major portion of the capital equipment needed to produce formed foil, can still be operated at maximum output power.

It can be readily appreciated that to a capacitor manufacturer using formed foil made according to the principles of this invention whereby the foil potential capacity density is known for every region along the length of the foil, the advantages are many fold and include lower costs, closer capacity tolerances and improved yields.

What is claimed is:

1. A method for determining the potential capacitance of an electrically formed valve-metal foil during a continuous oxide formation process comprising:

a. drawing continuously an etched valve metal foil through a liquid electrolyte;

b. applying a constant d.c. voltage between said foil and a counterelectrode that is in contact with said electrolyte;

c. maintaining the total current flowing between said foil and said counterelectrode at a constant predetermined value by varying the speed of said drawing; and d. recording said speed and its corresponding location along said foil to establish the potential capacitance for each region along said foil.

2. The method of claim 1 wherein said recording is accomplished by a. driving the paper in a strip chart recorder at a speed proportional to said foil drawing speed; and b. continuously moving the pen of said strip recorder on said paper a lateral distance that is proportional to said speed, so that the inked line on said paper has a lateral displacement in each region of said paper proportional to the capacitance of each corresponding region of said foil.

3. The method of claim 2 wherein said inked line contains magnetic particles, for the purpose of providing a means for either manually or automatically reading said recorded potential capacitance.

4. The method of claim 1, additionally comprising monitoring said speed of said drawing, wherein said foil drawing is accomplished by a variable speed motor connected to a mechanical coupling means for drawing said foil at a speed proportional to the speed of said motor and wherein said monitoring is accomplished by monitoring said speed of said motor.

5. The method of claim 4 wherein a tachometer is connected to said motor and said monitoring of said motor speed and thus of said drawing speed and thus of said potential capacity is accomplished by monitoring the output voltage of said tachometer.

6. The method of claim 4 wherein said motor is a d.c. shunt type, having the field winding connected to a fixed d.c. voltage and having a variable d.c. voltage applied to the armature winding, and wherein said monitoring of said motor speed is accomplished by monitoring said variable d.c. voltage.

7. The method of claim 1 wherein said recording is accomplished by driving a magnetic tape recorder at a speed proportional to said foil drawing speed; and recording said speed in said tape.

8. The method of claim 1 wherein said recording is accomplished by drawing a tape through a tape punch at a pace that is proportional to said foil drawing speed; and recording said speed by a coded punching of said tape.

9. The method of claim 1 wherein said recording is accomplished by drawing a film at a substantially constant speed, and repeatedly recording a first and a second value on said film, said first value corresponding to the distance along said foil and said second value corresponding to said speed of said foil drawing.

10. The method of claim 1 wherein said recording is accomplished by periodically marking the value of said potential capacitance at said corresponding locations on said foil.

11. The method of claim 10 wherein said marking is accomplished by magnetic-ink printing on said foil.

12. The method of claim 10 wherein said marking is accomplished by coded punching of said foil.

13. The method of claim 1 wherein said formed foil has a width that is greater than the foil width required for rolling capacitors, said method additionally comprising slitting said formed foil lengthwise into strips having said required widths and measuring the characteristic variation of etch ratio across said width of said formed foil to determine the appropriate correction factor to said recorded speed for each of said slit strips.

14. The method of claim 1 additionally comprising prior to said forming, slitting said foil to a width that is required for rolling capacitors.

15. The method of claim 1 additionally comprising cutting said foil to lengths according to said recorded speed and location, to produce in each said length a predetermined desired potential capacitance.

* * * * *